United States Patent [19]

Weimann

[11] Patent Number: 4,663,845

[45] Date of Patent: May 12, 1987

[54] UTILITY KNIFE

[75] Inventor: George F. Weimann, Avon, Conn.

[73] Assignee: Stanley Tools, New Britain, Conn.

[21] Appl. No.: 836,528

[22] Filed: Mar. 5, 1986

[51] Int. Cl.[4] ..... B26B 1/08

[52] U.S. Cl. ..... 30/162; 30/320

[58] Field of Search ..... 30/162, 2, 320

[56] References Cited

U.S. PATENT DOCUMENTS

| | | | |
|---|---|---|---|
| 1,456,786 | 5/1923 | DeLuca . | |
| 1,888,887 | 11/1932 | Readman . | |
| 2,112,518 | 3/1938 | Caplan . | |
| 2,632,244 | 3/1953 | Belsky | 30/162 |
| 2,948,961 | 8/1960 | Ortner | 30/162 |
| 3,314,148 | 4/1967 | Foellmi | 30/162 |
| 3,708,881 | 1/1973 | Bennett | 30/320 |
| 4,005,525 | 2/1977 | Gringer | 30/162 |
| 4,012,836 | 3/1977 | Baer et al. | 30/2 |
| 4,089,112 | 5/1978 | Richards | 30/162 |
| 4,509,260 | 4/1985 | Gringer | 30/162 |
| 4,586,256 | 5/1986 | Weimann | 30/320 X |

*Primary Examiner*—Jimmy C. Peters

*Attorney, Agent, or Firm*—Chilton, Alix & Van Kirk

[57] ABSTRACT

A knife holder for a utility knife is disclosed comprising an elongated case forming a blade opening at the forward end and an interior guide for guiding a blade carrier and a blade carrier adapted for mounting a blade and being slidably mounted to the guide for selective longitudinal movement between a retracted sheathed position and an extended unsheathed position. The blade carrier has outwardly extending flanges for supporting a blade and a retainer tab for laterally retaining the rearward portion of the blade and the case has a retainer protrusion at the blade opening for laterally retaining the forward end of the blade so that the retainer tab and the retainer protrusion coact to retain the blade to stabilize the blade during usage.

24 Claims, 5 Drawing Figures

UTILITY KNIFE

BACKGROUND AND SUMMARY OF THE INVENTION

This invention relates to a utility knife and more particularly to a utility knife handle for mounting a replaceable blade.

In retractable-blade utility knives, the blade is slidably movable from a sheathed position wherein the blade is enclosed in the knife handle to an extended unsheathed position wherein the knife blade projects through an opening in the knife handle to present a cutting edge. Such a utility knife is disclosed in Robinson, Jr., U.S. Pat. No. 3,107,426, entitled "Utility Knife" wherein the knife incorporates a blade carrier which mounts and supports the blade within the interior of the knife handle for selective longitudinal movement therein. The blade carrier includes a thumb actuated button to release the blade carrier from one of several latching positions for shifting the blade to another longitudinal position. The knife handle is disassembled by removal of a retaining screw to allow replacement of the blade within the carrier.

In other types of utility knives such as the fixed blade knife disclosed in the commonly assigned U.S. Pat. No. 4,524,518 to West entitled "Utility Knife", the knife holder comprises a pair of elongated mating handle members interconnected for relative pivotal movement. The pivotal movement of the handle members affords ready access to the interior of the knife holder in the open position for convenient and easy blade removal and replacement. In the closed position, the blade is securely mounted between the handle members for cutting operations.

Generally, it is desirable for a retractable utility knife to afford convenient and easy blade replacement as well as being economical to manufacture and safe in use. However, a common shortcoming in such knives is the characteristic of relatively loose blade condition when the blade is in the extended unsheathed position. That is, the mounted blade tends to exhibit a side wobble characteristic when the blade is advanced to the extended unsheathed position which can detrimentally affect the stability of the blade during cutting operations.

Accordingly, it is an object of the present invention to provide a new and improved retractable knife which alleviates blade instability and side wobble in extended unsheathed positions.

Another object of the invention is to provide such a retractable knife which affords easy and convenient blade replacement. Included in this objective is the provision of such a retractable knife with interconnected swivel case sections which afford blade replacement access without the necessity of tools or disassembly of the knife.

A further object of the invention is to provide such a retractable knife which is economical to manufacture. Included within this objective is the provision of a new and improved blade carrier for such a knife which is an integrally formed sheet metal component and economical to manufacture.

Yet another object of the invention is to provide such a retractable knife which is refined in appearance and durable in use.

Still another object of the invention is to provide a fixed blade utility knife which affords enhanced blade stability and convenient blade replacement.

Other objects will be in part obvious and in part pointed out more in detail hereinafter.

It has been found that the foregoing and related objects and advantages are attained in a knife holder which includes an elongated case having a forward blade retaining end, a rearward handle end, a blade opening in the forward end, and an interior guide for guiding a blade carrier. The blade carrier is adapted for mounting a replaceable blade and is slidably mounted to the guide of the case for selective longitudinal movement therealong between a retracted sheathed position and an extended unsheathed position wherein the forward portion of the blade mounted to the carrier extends through the blade opening to present a cutting edge. The blade carrier has a planar side portion, blade supports extending laterally from the planar side portion for supporting a blade so that one side surface of the blade faces against the planar side portion of the blade carrier, and a retaining tab assembly extending laterally from the planar side of the carrier for lateral retention of the rearward portion of the blade toward the planar side portion of the carrier. The case has an arcuate retainer at the blade opening for retaining the forward end portion of the blade toward the planar side portion of the carrier when the carrier is in an extended unsheathed position wherein the arcuate retainer coacts with the retainer tab when the blade carrier is in the unsheathed position to retain the side surface of the blade toward the planar side portion of the blade carrier to stabilize the blade during usage and ensure blade retention on the carrier.

In one embodiment, the blade carrier comprises a one piece sheet metal slide having upper and lower ends and forward and rearward ends. A web portion having a planar face for abutting the planar side surface of the blade extends between the upper and lower ends of the slide. An upper flange portion is integrally formed at the upper end of the slide so as to project laterally from the web portion with the flange being adapted to engage the upper end of the blade mounted within the slide. A lower flange portion is integrally formed at the lower end of the slide so as to project laterally from the web portion to engage the lower end of the blade mounted within the slide. The upper and lower flanges cooperate and coact to removably transversely retain the blade within the slide. A forwardly extending resilient button arm is integrally formed at the upper end of the slide and is adapted for manual actuation to selectively secure the carrier in a plurality of longitudinal positions within the case of the knife. A longitudinally extending guide rail is integrally formed on the web portion of the slide and projects outwardly therefrom intermediate the upper and lower ends of the slide. The guide rail is adapted for cooperative engagement with the guide of the case to guide the movement of the slide between the retracted sheathed position and the extended unsheathed position.

DESCRIPTION OF THE PREFERRED EMBODIMENT

Figure 1:
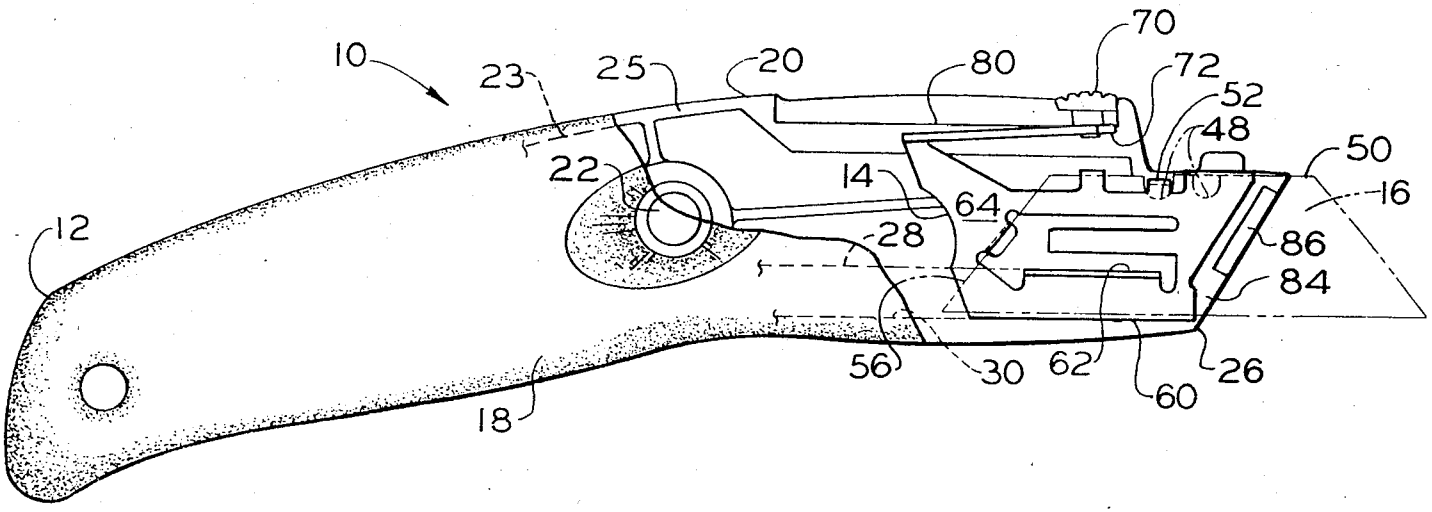
FIG. 1 is an elevational side view, partly broken away, of the retractable knife of the present invention with the blade (shown in phantom line) in an extended unsheathed operating position.

Although specific forms of the invention have been selected for illustration in the drawings and the following description is drawn in specific terms for the purpose of describing these forms of the invention, this description is not intended to limit the scope of the invention which is defined in the appended claims.

Referring to FIG. 1, a retractable knife is generally designated by the numeral 10 and is shown in an extended unsheathed cutting position. The knife 10 generally comprises a handle or case 12, a blade carrier 14, and a replaceable blade 16.

The elongated handle 12 comprises a pair of mating case sections 18, 20 which cooperate to form a hollow interior and an exterior contoured to facilitate manual grasping of the handle. Except as described hereinafter, the case sections 18, 20 are generally described in the commonly assigned U.S. Pat. No. 4,524,518 to West issued June 25, 1985, which is incorporated in its entirety herein by reference. As more particularly described in U.S. Pat. No. 4,524,518, the case sections 18, 20 are pivotally connected by a pivot assembly 22 to permit the case section 18, 20 to be pivotally movable in a swivel fashion between open and closed positions. The open position is shown in FIG. 1 of U.S. Pat. No. 4,524,518 and allows convenient and easy replacement of the blade and access to the storage compartment within the handle. The closed operational position is shown in FIG. 1 of the drawings herein.

The case sections 18, 20 have peripheral side walls 19, 21 which terminate in abutting shoulders 23, 25. The shoulders 23, 25 define mating surfaces which lie in a single longitudinal parting plane traversing the longitudinal centerline of the handle. The sections 18, 20 cooperate to form a blade opening 24 at the forward end 26 of the handle so that the blade 16 may be longitudinally moved by the blade carrier to an extended unsheathed position wherein the cutting edge of the blade extends through the opening 24 to present a cutting edge as shown in FIG. 1. The case section 20 forms an interior guide rail 28 extending longitudinally within the forward end of the handle 12 for guiding the carrier 14 between the sheathed and unsheathed positions. The case section 18 also forms a longitudinally extending interior guide rail 30 for guiding the blade carrier 14. As is explained in more detail hereinafter, the guide rails 28, 30 cooperate with a corresponding guide rail and guide surface on the blade carrier 14 to guide the longitudinal movement of the blade carrier between the sheathed and unsheathed positions.

Figure 4:
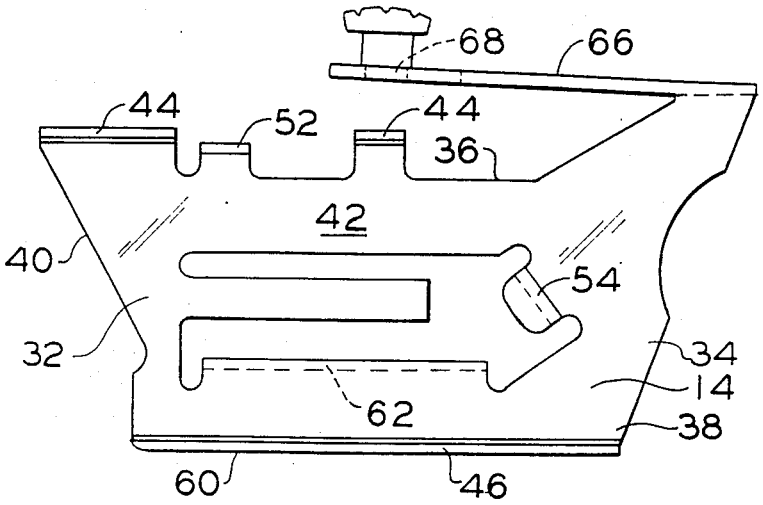
FIG. 4 is a side elevational view of the blade carrier of the present invention.

Referring to FIG. 4, the blade carrier 14 is in the form of an integral sheet metal slide which includes for purposes of description forward and rearward ends 32, 34 and upper and lower ends 36, 38. A generally upright web portion 40 extends between the upper and lower ends 36, 38. The web portion 40 has a planar face 42 for abutting against the planar side face of the blade 16 to provide lateral retention and support for the blade. A pair of spaced, blade-retaining flanges 44, 46 are positioned respectively at the upper and lower ends 36, 38 of the slide for vertical retention and support of the blade. The upper segmented flange 44 extends laterally generally perpendicular relative to the planar face 42 and outwardly therefrom. The lower flange 46 extends laterally generally perpendicular relative to the planar face 42 and outwardly therefrom. Both flanges 44, 46 are integrally formed by stamping, bending or the like at the respective upper and lower ends of the slide.

A locating lug 52 is integrally formed at the upper end of the slide 14 slightly below the flange 44 and extends generally outwardly from the planar face 42. The lug 52 is received within one of the locating notches 48 in the upper edge 50 of the blade 16 to retain the blade 16 in a fixed longitudinal position relative to the slide 14. A retaining tab 54 extends outwardly from the planar face 42 of the web 40 and is positioned intermediate the upper and lower flanges 44, 46 toward the rearward end 34. The retaining tab 54 is generally oriented obliquely relative to the flanges 44, 46 so as to engage the oblique end edge 56 of the blade 16 to also fix the longitudinal position of the blade 16. The retainer tab 54 is integrally formed with the slide 14 and extends outwardly and forwardly from the planar surface 42 to form a recess or trapping channel 58 between the retaining tab 54 and the planar face 42 roughly commensurate with (or slightly greater than) the thickness of the blade. For example, 0.031 inches is an acceptable width for the channel 58 for a blade having a thickness of 0.025 inches. When the blade is mounted in the slide, the end edge 56 and a portion of the rearward end of the blade is captured or trapped in the recess 58 to laterally retain the blade in the slide 14.

The lower surface 60 of the lower flange 46 is planar and extends longitudinally to form a guide surface to ride on the guide rail 30 of case section 18. A guide rail 62 is positioned on the planar side surface 64 of web 40 and extends outwardly therefrom. The guide rail 62 is integrally formed with the slide 14 by stamping, bending or the like and extends longitudinally along the slide parallel to the lower guide surface 60. The guide rail 62 is positioned intermediate the upper and lower ends of the slide 14 so as to cooperatively engage the bottom of the guide rail 28 of the case section 18. Consequently, the guide rail 62 and the guide surface 60 of the slide 14 cooperatively engage interior guide rails 28, 30 of the handle 12 to retain and guide the carrier 14 for longitudinal movement between the retracted sheathed position and the extended unsheathed position.

Figure 5:
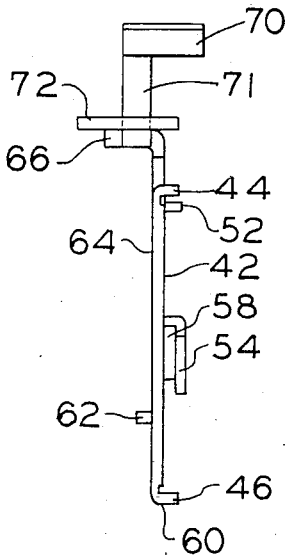
FIG. 5 is a front elevational view of the blade carrier of FIG. 4.

A resilient button arm 66 is integrally formed at the rearward portion of the upper end of the slide 14 so as to extend forwardly and slightly upwardly therefrom. The button arm 66 has a rectangular slot 68 therethrough for mounting the thumb button 70 by staking or the like. As can be seen in FIG. 5, the resilient finger 66 is offset from the vertical plane of the web portion 40 so as to project outwardly relative to the side surface 64. An outwardly projecting latching tab 72 is positioned at the forward terminus or distal end of the button arm 66. The latching tab 72 is biased upwardly by the resilience of the button arm 66 so as to be received in any one of the notches (not shown) in the top interior of the case section 18 in a conventional manner. Reference is made to commonly assigned U.S. Pat. No. 4,524,518 to West and to commonly assigned U.S. patent application Ser. No. 658,584 of C. Stoutenberg entitled Retractable Knife Handle filed Oct. 5, 1984, which are incorporated in their entirety herein by reference, as exemplary of the selective latching of the blade carrier in the various positions. Similar to these references, the notches in the top interior of the case section 18 are longitudinally spaced to define multiple extended or unsheathed positions of the blade 16 and one sheathed position. The first unsheathed position generally exposes only the pointed tip of the blade for purposes of scoring while the remaining unsheathed positions are general cutting positions. The stem 71 of the button 70 extends through a longitudinal slot 80 formed at the top of the case sections 18, 20 so as to mount the button 70 for longitudinal movement in the slot. The blade carrier 14 may be manually longitudinally shifted by pressing the thumb button 70 to unlatch the latching tab 72 from one of the respective notches and thereafter longitudinally moving the blade with respect to the case sections.

Preferably, the slide 14 is a sheet metal component integrally formed by stamping, punching, or the like. Economy of manufacture is attained with the compact configuration of the finished slide and the blank for making the slide, and a stable slide for securely carrying the blade 16 in the complementary handle 12 is thus obtained.

Figure 2:
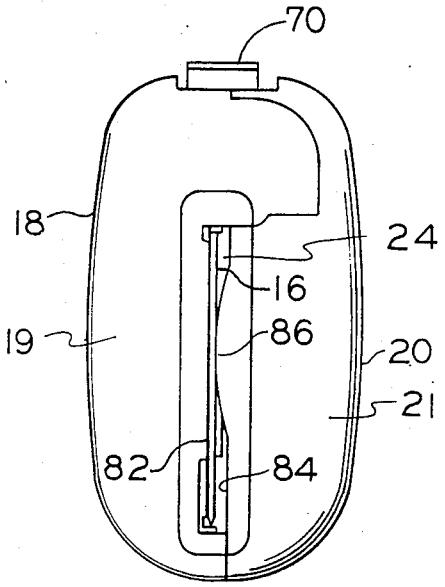
FIG. 2 is an enlarged front elevational view of the knife of FIG. 1.
Figure 3:
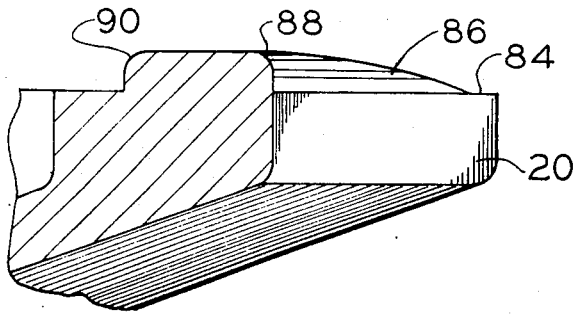
FIG. 3 is an enlarged, slightly exaggerated, perspective view, partly in section and partly broken away, of the retainer of the case of the knife of FIG. 1.

Referring to FIG. 2, the blade opening 24 is in the form of an elongated slot in the forward end of the handle 12 and having a longitudinal axis transverse to the path of travel of the carrier 14. The opening 24 is defined by the opposed side walls 82, 84 formed in the case sections 18, 20 respectively. The side wall 84 has an arcuate retainer 86 for preventing the blade from moving away from the carrier when the blade is in the extended cutting positions. The retainer 86 is in the form of an arcuate convex protrusion integrally formed on the side wall 84 which projects toward the side wall 82 through the parting plane of the handle 12 sufficiently to laterally retain the blade in the carrier during cutting operations yet permit the blade to be manually extended and retracted through the blade opening. The arcuate retainer 86 has an outwardly disposed rounded lateral edge 88 and an inwardly disposed rounded lateral edge 90 as best seen in FIG. 3 to facilitate the longitudinal movement of the blade.

The arcuate retainer 86 extends along the side wall 84 in the direction of the longitudinal axis of the opening 24. As can be seen in FIG. 2, the longitudinal dimension of the arcuate protrusion 86 is less than the longitudinal dimension of the slot 24 and the protrusion 86 is positioned toward the upper end of the slot 24 so as to laterally retain the blade in the carrier in the two extended cutting positions. In these cutting positions, the retainer 86 permits wider manufacturing tolerances while alleviating side wobble of the blade in an extended cutting position.

Moreover, the retainer 86 also functions to retain the blade on the carrier 14 during the swivel movement of the case sections 18, 20 to the closed position. That is, the retainer 86 extends past the parting plane toward the case section 18 so as to retain the blade on the carrier and prevent the lug 52 from disengaging from the notch 48 when the blade is in an extended cutting position and the case sections 18, 20 are swiveled to a closed position. As the case sections are swiveled to a closed position, the retainer 86 will slide or cam over the blade to retain the blade in engagement with the lug 52. Accordingly, the retainer also facilitates blade replacement.

While the foregoing is primarily directed to a retractable blade utility knife, the retainer 86 is also advantageously utilized on a fixed blade knife such as the one disclosed in West, U.S. Pat. No. 4,524,518. In the fixed blade knife, the retainer extends sufficiently toward the opposing side wall so as to engage the planar side of the blade and thereby securely clamp the blade between the opposing sidewall and the retainer 86 for heavy duty cutting operations. In mounting a blade within the knife, the retainer will engage the side of the blade as the case sections are swiveled to a closed position so as to cam into the side of the blade and retain it against the opposing case section during the relative swivel movement of the case sections. Accordingly, the retainer functions to retain the blade in place during the closure movement of the case sections and to securely clamp the blade in the cutting position for enhanced blade stability.

As can be seen, the utility knife of the present invention alleviates blade instability and side wobble while affording easy and convenient blade replacement and economy of manufacture. As will be apparent to persons skilled in the art, various modifications and adaptations of the structure above described will become readily apparent without departure from the spirit and scope of the invention, the scope of which is defined in the appended claims.

I claim:

1. A blade holder for a detachable blade of the type having first and second opposing planar side surfaces, forward and rearward end portions and a cutting edge comprising:

an elongated case having a forward end and a rearward handle end, said case forming a blade opening at said forward end and interior guide means for guiding a blade carrier, said blade opening comprising a slot defined by opposed side walls formed in said case and a blade carrier adapted for mounting a blade and being slidably mounted to said guide means for selective longitudinal movement therealong between a retracted sheathed position and an extended unsheathed position wherein the forward portion of a blade mounted to said carrier extends through said blade opening to present a cutting edge, said blade carrier having a planar side portion, means extending laterally from said planar side portion for supporting a blade so that one side surface of the blade faces against the planar side portion of the blade carrier, and retaining tab means for laterally retaining the rearward portion of the blade toward said planar side portion of said carrier, said case having retainer means at said blade opening comprising an arcuate convex protrusion integrally formed on one of said side walls and projecting toward the other side wall for laterally retaining the forward end portion of a blade toward said planar side portion of said carrier when said carrier is in an extended unsheathed position, said retainer means of said case coacting with said retainer tab means of said carrier when the blade carrier is in an unsheathed position to laterally retain the blade toward the planar side portion of the blade carrier to stabilize the blade during usage.

2. The device of claim 1 wherein said slot has a longitudinal axis transverse to the path of travel of said carrier and said arcuate protrusion extends along said one side wall in the direction of said longitudinal axis.

3. The device of claim 2 wherein said slot has upper and lower ends and the longitudinal dimension of said arcuate protrusion is less than the longitudinal dimension of said slot and said protrusion is positioned toward the upper end of the slot.

4. The device of claim 1 wherein said arcuate protrusion has a rounded lateral edge disposed inwardly into said case.

5. The device of claim 1 wherein said case comprises a pair of complementary opposing elongated body sections defining a longitudinal parting plane along the centerline of said case and having opposed surfaces for mating engagement, said mating surfaces lying in said parting plane, pivot means connecting said sections so that said sections are pivotally movable between an open position and a closed position, said pivot means extending transverse of said opposed surfaces intermediate said forward and rearward ends of said case.

6. The device of claim 5 wherein said arcuate protrusion projects through said parting plane to retain a blade on said carrier during relative pivotal movement of said body sections to said closed position when the blade is in the extended unsheathed position.

7. A holder for a detachable blade comprising:

first and second complementary elongated case sections adapted for mating engagement to form an elongated case having a foward blade mounting end and a rearward handle end, said case sections having opposed surfaces for mating engagement defining a longitudinal parting plane along the centerline of the case, pivot means connecting said case sections so that said sections are pivotally movable between an open and a closed position, said pivot means extending transverse of said opposed surfaces intermediate said forward and rearward ends, said first and second case sections having opposing spaced first and second side wall portions respectively cooperating in the closed position to define an elongated blade opening slot at the forward end, blade mounting means for longitudinally positioning a blade within said blade mounting end so as to extend through said blade opening to present a cutting edge when said case sections are in a closed position, and a tapered projection integrally formed on one of said first and second side wall portions of said slot and extending toward the other of said first and second side wall portions when said case sections are in a closed position so as to securely and intimately confine a blade between said projection and said other side wall portion when said case sections are in a closed position, said tapered projection having an apex positioned at about the midpoint of said slot.

8. The device of claim 7 wherein said projection extends toward said first side wall portion sufficiently to engage a blade and securely clamp the blade between said projection and said first side wall portion when said case sections are in a closed position.

9. The device of claim 7 wherein said projection extends through said parting plane so as to laterally retain a blade mounted on said mounting means so as to extend through said blade opening to present a cutting edge during movement of said case sections from said open position to said closed position.

10. The device of claim 9 wherein said projection extends through said parting plane sufficiently to engage a blade mounted within said mounting means to present a cutting edge during movement of said case sections from said open position to said closed position to laterally retain the blade during closing.

11. The device of claim 7 wherein said retainer projection comprises an arcuate convex protrusion integrally formed in said second side wall and projecting toward said first side wall portion.

12. The device of claim 7 wherein said protrusion has a rounded lateral edge disposed inwardly into said case.

13. The device of claim 7 wherein said slot has a longitudinal axis transverse to the longitudinal axis of a blade mounted in said blade mounting means and said projection extends along one of said second side wall portions in the direction of said longitudinal axis.

14. The device of claim 13 wherein said slot has upper and lower ends and the longitudinal dimension of said projection is less than the longitudinal dimension of said slot and said projection is positioned toward the upper end of the slot.

15. The device of claim 7 which comprises said retainer projection positioned adjacent the forward end portion of a blade mounted within the blade mounting means and presenting a cutting edge and means for laterally retaining the rearward end portion of the blade within said mounting means.

16. A blade holder for a detachable blade of the type having first and second opposing planar side surfaces, forward and rearward end portions and a cutting edge, comprising:

an elongated case having a forward blade retaining end and a rearward handle end, said case forming a blade opening at said forward end and interior guide means for guiding a blade carrier and a blade carrier adapted for mounting a blade and being slidably mounted in said case for selective longitudinal movement therealong between a retracted sheathed position, and an extended unsheathed position where the forward portion of a blade mounted to said carrier extends through said blade opening to present a cutting edge, said blade carrier comprising a single piece sheet metal slide having a web portion having a planar face for abutting the planar side surface of a blade, said web portion extending between the upper and lower ends of said slide, a retainer tab integrally formed on said web portion so as to project laterally therefrom to form a channel between said web portion and said tab to laterally retain a blade against the web portion, an upper flange portion integrally formed at the upper end of said slide so as to project laterally from the web portion, said flange adapted to engage the upper end of the blade mounted within said slide, a lower flange portion integrally formed at the lower end of said slide so as to project laterally from the web portion in a first direction and being adapted to engage the lower end of a blade mounted within said slide, said upper and lower flanges coacting to removably transversely retain a blade within said slide, a resilient button arm integrally formed at said upper end of said slide and extending forwardly, said arm being adapted for manual actuation to selectively secure said slide in a plurality of longitudinal positions within said case, and a longitudinally extending guide rail integrally formed on said web portion and projecting outwardly therefrom in a second direction generally opposite said first direction said guide rail being disposed intermediate said upper and lower ends of said slide, said guide rail cooperatively engaging said guide means of said case to guide the movement of said slide between the retracted sheathed position and the extended unsheathed position.

17. The device of claim 16 wherein said slide comprises a platform integrally formed at the upper end of the slide so as to project laterally therefrom and having forward and rearward ends, said resilient finger being integrally formed at the rearward end of the platform and extending forwardly and upwardly therefrom.

18. The device of claim 17 wherein said slide has first and second opposing sides and said platform projects laterally outwardly from said first side and said upper and lower flange portions project laterally outwardly from said second side.

19. The device of claim 18 wherein said guide rail projects laterally from said first side of said slide.

20. The device of claim 18 wherein said slide has a lower edge forming a guide surface, said guide surface and said guide rail cooperatively engaging said guide means of said case to guide the movement of the slide between the retracted sheathed position and the extended unsheathed position.

21. The device of claim 16 wherein said slide has first and second opposing sides and said guide rail projects laterally outwardly from said first side and said upper and lower flange portions project laterally outwardly from said second side.

22. The device of claim 16 wherein said case has an arcuate retainer means at the blade opening for retaining the forward end portion of a blade toward the planar face of the web portion of the slide when the slide is in an extended unsheathed position, said arcuate retainer means of said case coacting with the retainer tab means of said slide when the slide is in an unsheathed position to retain the blade toward the planar face of the web portion to stabilize the blade during usage.

23. A blade holder for a detachable blade comprising:

first and second complementary elongated case sections adapted for mating engagement to form an elongated case having a forward blade mounting end and a rearward handle end, said case sections having opposed surfaces for mating engagement defining a longitudinal parting plane along the centerline of the case, pivot means connecting said case sections so that said sections are pivotally movable between an open and a closed position, said pivot means extending transversely of said opposed surfaces intermediate said forward and rearward ends, said first and second case sections having opposing spaced first and second side wall portions respectively cooperating in the closed position to define an elongated blade opening slot at the forward end, blade mounting means for longitudinally positioning a blade within said blade mounting end so as to extend through said blade opening to present a cutting edge when said case sections are in a closed position, and retainer means at said blade opening for laterally retaining the forward end portion of a blade when the blade extends through the opening in the closed position, said retainer means projecting to retain a blade on said blade mounting means by slidably engaging and riding over said blade during relative pivotal movement of said case sections to the closed position.

24. The device of claim 23 wherein said retainer means comprises a protrusion extending from one of said side wall portions and having an arcuate contour so that said protrusion cams against a blade on said blade mounting means during pivotal movement to the closed position.

* * * * *